US006412320B1

(12) United States Patent
Maniago

(10) Patent No.: US 6,412,320 B1
(45) Date of Patent: Jul. 2, 2002

(54) CLOSING DEVICE FOR A LOCK

(76) Inventor: Rolf Maniago, Nikolaus-Otto-Strasse 5, D-55129 Mainz (DE)

( * ) Notice: Subject to any disclaimer, the term of this patent is extended or adjusted under 35 U.S.C. 154(b) by 0 days.

(21) Appl. No.: 09/555,670

(22) PCT Filed: Oct. 1, 1999

(86) PCT No.: PCT/EP99/07262

§ 371 (c)(1),
(2), (4) Date: Jun. 1, 2000

(87) PCT Pub. No.: WO00/20711

PCT Pub. Date: Apr. 13, 2000

(30) Foreign Application Priority Data

Oct. 2, 1998 (DE) ..... 198 45 515

(51) Int. Cl.[7] ..... E05B 37/02

(52) U.S. Cl. ..... 70/277; 292/140; 70/107; 70/111; 70/279; 70/280; 70/311; 70/312

(58) Field of Search ..... 70/277, 111, 150, 70/145, 153, 478, 482, 481, 312, 444, 74, 311; 292/169.18, 150, 140

(56) References Cited

U.S. PATENT DOCUMENTS 4,295,349 A * 10/1981 Wasserfaller ..... 70/111
4,682,483 A * 7/1987 Werner ..... 70/312
4,899,562 A * 2/1990 Gartner et al. ..... 70/277
5,083,448 A * 1/1992 Karkkainen et al. ..... 70/277

* cited by examiner

*Primary Examiner*—William A. Cuchlinski, Jr.
*Assistant Examiner*—Tuan C To
(74) *Attorney, Agent, or Firm*—Heslin Rothenberg Farley & Mesiti P.C.

(57) ABSTRACT

A closing device for a lock, comprising a pivoting bolt that can be closed in a forward and retracted position with the aid of a locking means. The invented device also comprises a closing element (13) that accommodates the bolt in a forward close position and a locking and unlocking device for said bolt. The locking and unlocking device comprises at least one locking element (17, 18) that can be moved forwards into the movement area of the bolt or retracted, whereby the pivoting bolt is secured in a forward position against closure in a retracted position or retracting from the forward close position. When in a locked position, mechanical door-side interventions on the locking mechanism of the locking cylinder or the pivoting bolt-lock do not result in a closing movement of said bolt.

10 Claims, 3 Drawing Sheets

CLOSING DEVICE FOR A LOCK

DESCRIPTION

Figure 1:
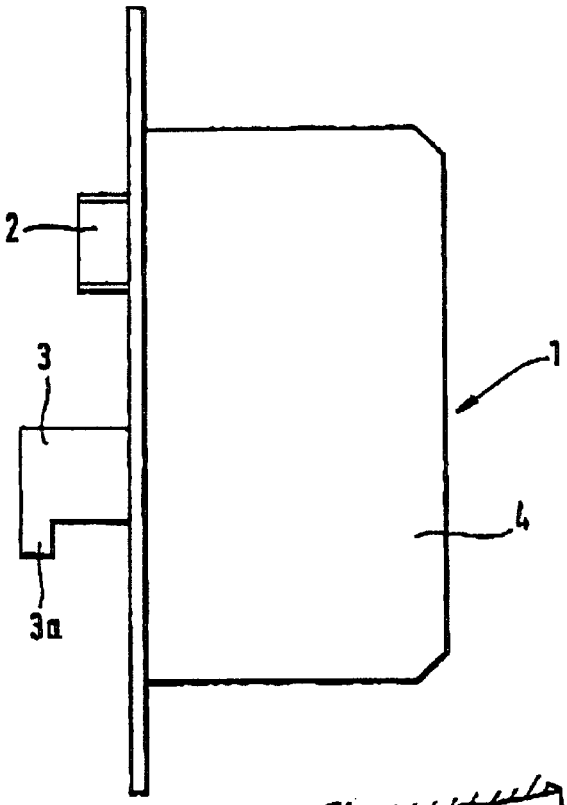

The invention concerns a closing device for a lock which lock possesses a forwardly movable and retractable, pivoting bolt with an arresting latch.

Known door locks exhibit a catch for locking and a bolt for securing the door. The bolt, emerging from the door lock, engages itself in a recess of the door framing or in a opening of a metal plate, so that the door becomes locked. This is carried out with the aid of a closing/opening operating means, i.e. a key and/or a locking cylinder. An arresting latch retains the bolt in its forwardly positioned state. When the bolt is to be retracted by the said operating means, the door can once again be opened upon activation of the arresting latch.

Conventional locks have either a horizontally slidable or a pivoting bolt. Locks with the latter bolt are accordingly designated as "pivot locks". Insertable locks are known, which are placed into a lock-recess in the door panel and are secured by screws. Box locks are fastened in a side recess of the door panel.

Without an appropriate key, these locks can be opened relatively simply by a lock-pick or by boring, whereby, in either case, entry into the locking mechanism is effected. In order to make door opening more difficult without a suitable key, safety-lock cylinders find use. Covers for the locks or a metal plate on the outside of the door offer protection from boring into the lock.

A safety locking apparatus is disclosed by DE 38 19 070 C1, which is applicable to additional locking security of doors. This does not function, however, with a lock in which the bolt moves forwards and backwards.

Again, DE 44 25 313 A1 proposes an arrangement comprised of a lock and a closure apparatus, wherein the closure apparatus possesses a separate security bolt, which is to be found in the door framing. This security bolt enters into a recess in the door panel.

DE 196 01 959 A1 teaches of a lock, which, by means of a transponder, can be activated without being touched. The mechanical locking mechanism of this lock, however, has not been described.

Thus the invention has the purpose of creating a closing device for a pivot lock, which offers increased safety against unauthorized unlocking and opening by lever actuated tools, but for which additional security bolts or the like are not necessary.

This purpose is achieved, in accord with the invention, with the features of claim 1.

The invented lock apparatus encompasses a closure device to receive the pivoting bolt in its forward locking position. The closure device can be sheet metal, which can be screwed into either the door framing or an inset housing in said door framing or yet, the closure device can be integral with the door framing or the said inset housing.

The security of the lock is increased by a locking/unlocking arrangement, which blocks the pivoting bolt in its forward placement against retraction. In the locked condition, invasive mechanical attack of the lock-cylinder or pivot-lock on the door cannot bring about any movement of the bolt. Even when the closure cylinder is turned back, or the lock operated by a skeleton key, or bored into, the bolt cannot be retracted. Since the security locking device is in the door frame or the masonry, it is protected from attack. The pivoting bolt can only be retracted by authorized release.

The lock/unlock device is fully independent of the locking system of the lock. Since two independent closure mechanisms are involved, the lock cannot be unlocked by a non-authorized person even with the proper key. The closure device can thus not only contribute to a higher degree of security, but also can be put to use by persons of upper supervisory levels to prevent entry by persons, who may possess a key which fits the lock. In cases of need, the closure device permits a central removal of the blocking of the bolt.

The lock/unlock arrangement can be integrated into a conventional lock housing, which is set into the door frame or the masonry thereof For the security of the pivoting bolt against retraction, the lock/unlock arrangement exhibits at least one locking device, which can be inserted into or withdrawn from the forward and retracting zone of the pivoting bolt, i.e. the said device can be thrust forward or pulled back. The locking device forms a detent, which prevents the pivoting bolt from being retracted from its forward locked position.

In a favorable embodiment, the lock/unlock arrangement includes a sender for the emitting of a coded lock/unlock-signal to a receiver for the input of said coded lock/unlock signal to an activation means, with which the locking device is caused to enter or leave, that is, move forward or back, in the forward and retracting zone of the bolt, when the receiver receives the lock/unlock signal. The lock can correspondingly be only opened, if not only the authorized key, but also a sender with the authorized code is present. Even when the code of the sender is stolen, an opening of the lock is possible only through mechanical destruction. In the latter event, at least knowledge of the break-in can be obtained.

The sender and the receiver can emit and receive radio signals. It is also possible that an optical sender can be used. The use of the known transponder with the non-contact reader or other code card scanner is a favorable arrangement.

Advantageously, two blocking elements are provided, which can bar the locking movement of the pivoting bolt from two sides. The locking, however, can be effected from only one side. The blocking elements are preferably, two oppositely situated spheres. Alternately, the blocking elements can be provided as rods or the like.

In another advantageous embodiment, the activation means comprises an obstructing slider, which can be part of the sphere support surfaces, which surfaces then run at such a slant, that the spheres, upon the displacement of said slider, are pushed in one direction, and again, when pushed in the other direction, are released.

Upon an effort, to retract the pivoting bolt by force, then the pivoting bolt impacts against the blocking spheres, which abut the support surfaces of the slider, so that the locking path is blocked. The activation of the blocking slider can be accomplished either electronically or with an electric motor powered positioning device.

The metal plate of the blocking mechanism, in the open position, or the pivoting bolt, can be spring loaded against retraction from the secure position.

Figure 2:
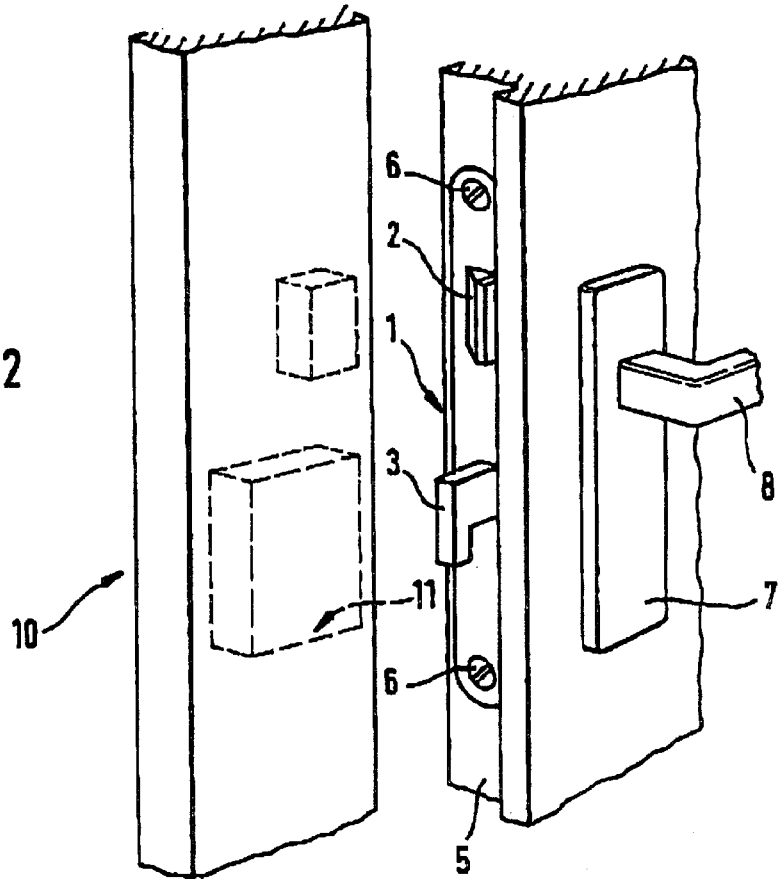
Figure 3:
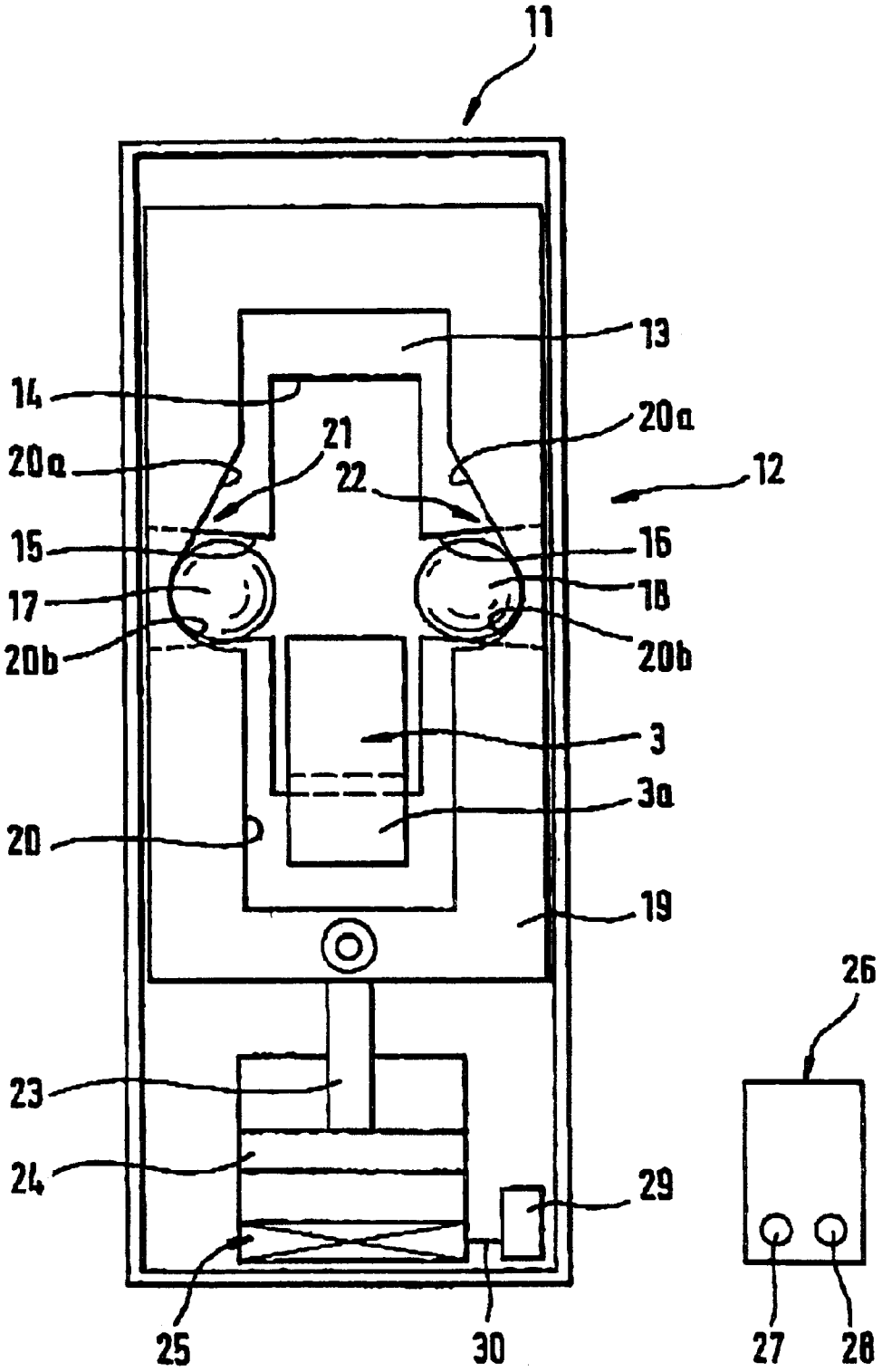
Figure 4:
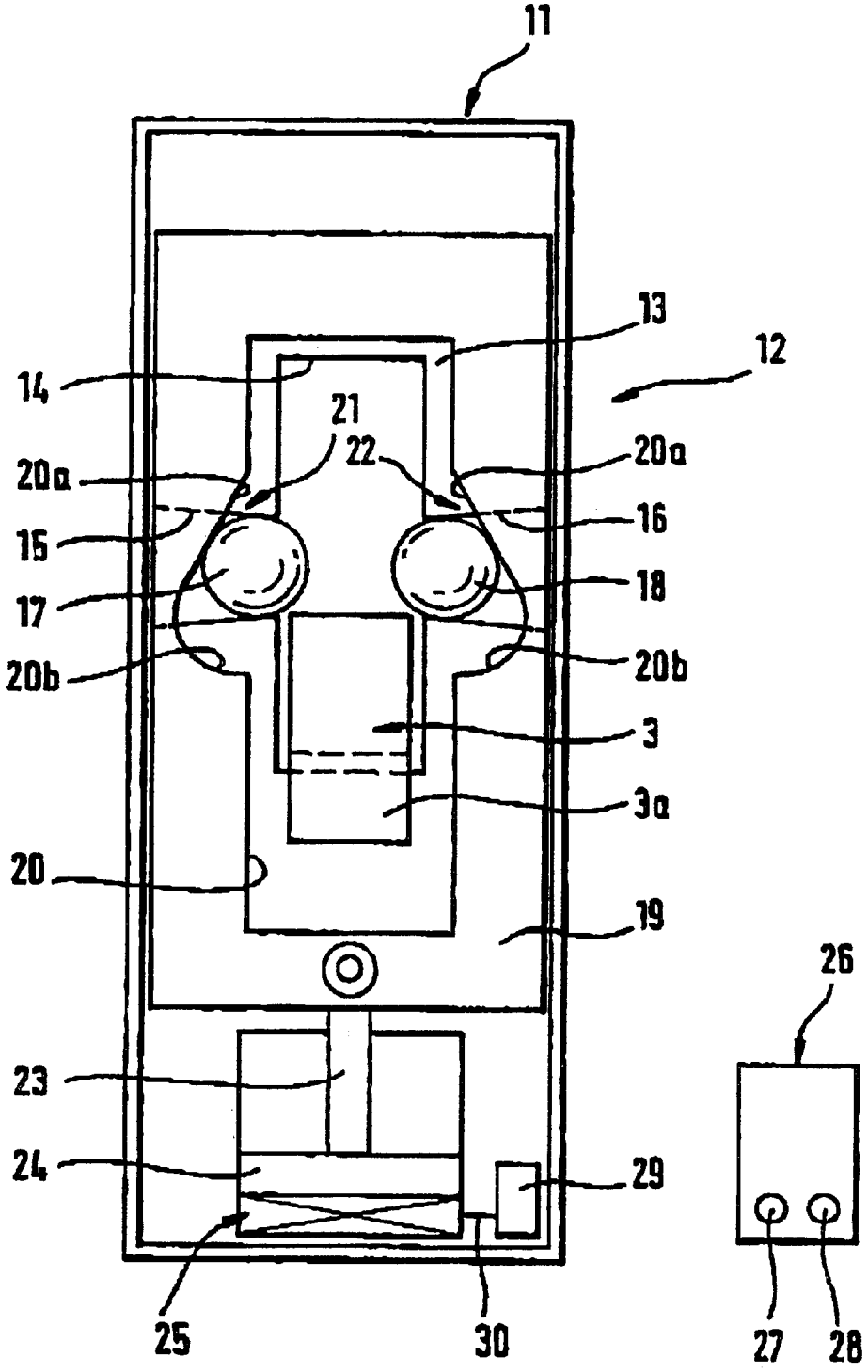

In the following, with the aid of drawings, an example embodiment will be described and explained in greater detail. There is shown in:

FIG. 1 a simplified presentation in profile view of the pivoting bolt,

FIG. 2 a door with the pivot lock of FIG. 1 and a door frame for the insertion of the closure apparatus in accord with the invention, FIG. 3 a simplified, schematic presentation of the invented closure apparatus in the opened lock position, and FIG. 4 a simplified, schematic presentation of the invented closure apparatus of FIG. 3 in the blocked position.

FIG. 1 shows a pivot lock 1 in a simplified illustration. The pivot lock 1 possesses a catch 2 for the locking of the door and a pivoting bolt 3, which serves for the locking of the door. The pivoting bolt 3 can be thrust forward, and retracted, by a key operated drive arrangement, found in the insert lock housing 4. An arrest takes over the securement of the bolt in the forward locked position. The pivoting bolt of the insertable lock is designed as a hooked bolt.

FIG. 2 depicts the insertable lock 1, which is set into an open compartment of the door panel 5 and secured there with screws 6. The plate and the door handle are designated, respectively, by the reference numbers 7 and 8.

In the door frame 10, a bolt box housing 11 is inset, which contains the invented closure apparatus 12 The bolt box housing 11 with the said closure apparatus 12, is shown in the subsequent FIGS. 3 and 4 in detail.

The bolt box housing 11 possesses a front side closure plate 13 with a right angled bolt window 14. In the forwardly locked position, this window 14 accepts the pivoting bolt 3, the hook 3*a* whereof also penetratively extends over the closure plate 13. Thereby, the door is locked.

On both sides of the said bolt window 14, are deposed lateral guides 15 and 16 of the bolt box housing 11. These are located above the blocking spheres 17, 18 for the pivoting bolt 3. Preferably, the said spheres 17, 18 are made of steel. The blocking spheres are irretrievably secured within the confines of the guides. However, the said spheres can be pushed forward and back in the guides 15, 16. In the retracted position, the blocking spheres release the bolt window 14 (FIG. 3), while the blocking spheres, when in their forward position limit the inside border of the said window 14 (see FIG. 4).

The blocking spheres, 17 and 18 can be pushed by means of a blockage slider 19 which is longitudinally slidable in the bolt box housing 11. The blockage slider 19 is a plate, preferably of steel, with a central cutout 20, which is larger than the bolt window 14. The longitudinal edges of the cutout 20 exhibit respectively a straight section 20*a,* which then runs on the slant towards the outside. Onto this slanting section 20*a,* which runs toward the outside, connects bow-shaped sections 20*b,* which reverse the curvature toward the inside. The sections form the side surfaces 21, 22 on which the blocking spheres 17, 18 are seated.

When the blocking slider 19 is in the position shown in FIG. 3, then the blocking spheres 17, 18 are freely movable in the guides 15, 16. The pivoting bolt 3 can now forwardly, lockingly penetrate into bolt box housing 11. If the blocking slider 19, on the other hand, as shown in FIG. 4, is pushed into the position shown in FIG. 4, then the blocking slider 19 presses the blocking spheres 17, 18 inwardly, which are seated on the support surfaces 21, 22 so that the closure/opening path of the pivoting bolt 3 is now obstructed.

Connected to the blocking slider 19 is a push rod 23, which in turn is fastened to the armature 24 of an electromagnets 25. The control of the electromagnets is effected by a sender 26, which is governed by respective lock, unlock buttons 27, 28.

Upon the activation of button 27 of said lock/unlock buttons 27, 28, the sender transmits a coded lock/unlock signal. To receive this signal, a receiver 29 is provided, which through a control line 30 is in communication with the electromagnets 25. When the receiver 29 receives a coded locking signal, then the electromagnet 25 is energized, whereby the blocking slider 19 moves into the blocking position (FIG. 4). Upon the activation of the unlocking button 28, then the blocking slider 19 is moved back in the open lock direction (FIG. 3) so that the blocking spheres 17, 18 release the lock window 14. The pivoting bolt 3 can now be retracted with a key. Unauthorized persons, however, who do not exercise control over the sender 26, cannot open the lock themselves, if they attempt an incursion into the locking mechanism, because the bolt is held in arrest by the door frame.

The locking apparatus can be installed, or built into any door and creates a high degree of security against unauthorized opening.

What is claimed is:

1. A closure device for a lock, which possesses a reciprocating, locking, pivoting bolt with an arrest means, said device having a locking assembly (12) for the acceptance of the pivoting bolt of the lock, characterized by a lock and unlocking apparatus with at least one blocking element (17, 18) which can be brought into the forward and back movement zone of the pivoting bolt (3), so that the pivoting bolt (3) in its forward locked position is secured against retraction and also blocking elements (17, 18) can be brought out of the said zone, so that the pivoting bolt can be retracted.

2. A closure device apparatus in accord with claim 1, therein characterized, in that the lock and unlock apparatus possesses a sender (26) for the sending of a coded lock or unlock signal, a receiver (29) for the reception of the coded lock or unlock signal and exhibits an activation apparatus (19, 24, 25) with which the at least one blocking element (17, 18) can be brought into the—or out of the—pivoting movement zone of the pivoting bolt.

3. A closure device in accord with claim 1 or 2, therein characterized, in that two blocking elements are provided, which are blocking spheres (17, 18) which are seated in respective guides (15, 16).

4. A closure device in accord with claim 3, therein characterized, in that the activation apparatus (19) encompasses a blocking slider (19) which possesses support surfaces (20*a,* 20*b*) respectively for the blocking spheres (17, 18), which said support surfaces are inclined in such a way that the blocking spheres (17, 18) upon pushing of the blocking slider (19) are moved forward into one position, and by the retraction of the blocking slider (19) in the other direction, said blocking spheres are released.

5. A closure device in accord with claim 4, therein characterized in that the activation apparatus for the movement of the blocking slider exhibits an electromagnetic or and electromotor driven positioning apparatus (24, 25).

6. A closing arrangement comprising a closing device which possesses a forwardly movable and retractable pivoting bolt with an arresting latch, said device being adapted to be inserted into a door, and a separate locking apparatus for reception of the pivoting bolt of the closing device, said locking apparatus being adapted to be inserted into a door frame, therein characterized, in that the locking apparatus includes a lock and unlock apparatus subject to activation, which is independent of the position of said pivoting bolt, with at least one blocking element, which can be brought into a movement zone of the pivoting bolt of the closing device, so that the pivoting bolt in a forward locking position is secured against retraction, and said at least one blocking element can be brought out of said movement zone, so that the pivoting bolt is retractable.

7. A closing arrangement in accord with claim 6, therein characterized, in that two blocking elements are provided, which are blocking spheres seated in oppositely situated guides.

8. A closing arrangement in accord with claim 7, further comprising activation apparatus including a blocking slider, which includes support surfaces for the blocking spheres which surfaces run angularly in such a way in relation to one another that the blocking spheres are released upon the movement of the blocking slider in an open lock direction.

9. A closing arrangement in accord with claim 8, therein characterized, in that the activation apparatus includes an electro-magnetic or electro-motorized driven positioning member for sliding of the blocking slider.

10. A closing arrangement in accord with claim 6, therein characterized, in that the lock and unlock apparatus includes a sender for sending of a coded lock or unlock signal, a receiver for reception of the coded lock or unlock signal and an activation apparatus, with which the at least one blocking element can be brought into or out of the movement zone of the pivoting bolt.

* * * * *